United States Patent [19]

Sheldon et al.

[11] Patent Number: 4,721,524

[45] Date of Patent: Jan. 26, 1988

[54] NON-PYROPHORIC SUBMICRON ALLOY POWDERS OF GROUP VIII METALS

[75] Inventors: Zachary D. Sheldon, Buffalo; Peter T. B. Shaffer, Grand Island, both of N.Y.

[73] Assignee: PDP Alloys, Inc., Grand Island, N.Y.

[21] Appl. No.: 909,167

[22] Filed: Sep. 19, 1986

[51] Int. Cl.[4] ..... B22F 1/00

[52] U.S. Cl. ..... 75/0.5 A; 75/0.5 AA; 75/0.5 BA; 75/251

[58] Field of Search ..... 75/251, 0.5 A, 0.5 BA, 75/0.5 AA

[56] References Cited

U.S. PATENT DOCUMENTS

| | | | |
|---|---|---|---|
| 1,832,307 | 11/1931 | Kingsbury | 420/456 |
| 2,269,497 | 1/1942 | Vilensky | 420/456 |
| 2,977,327 | 3/1961 | Rayney | 502/301 |
| 3,032,515 | 5/1962 | Hinsvark | 502/244 |
| 3,438,770 | 4/1969 | Clark et al. | 420/456 |
| 3,882,050 | 5/1975 | Niebylski | 502/326 |
| 3,992,192 | 11/1976 | Vartanian | 75/0.5 BA |
| 4,081,710 | 3/1978 | Heywood et al. | 313/141 |
| 4,447,391 | 5/1984 | Mizuhara | 420/456 |
| 4,485,153 | 11/1984 | Janikowski et al. | 428/688 |
| 4,539,041 | 9/1985 | Figlarz | 75/0.5 AA |

*Primary Examiner*—Peter D. Rosenberg

*Attorney, Agent, or Firm*—John Gibson Semmes

[57] ABSTRACT

Metal products herein are essentially submicron alloy powders of Group VIII base and Group VIII noble metals having non-pyrophoric and magnetic properties. One such product is prepared with isomorphous compounds of nickel and palladium, in a quantitative weight ratio of at least 99% of the former and 1% or less of the latter. The palladium is homogenously dispersed in the product nickel structure sites. An aqueous chemical process involving spontaneous nucleation is employed in the manufacture of the alloy product. In preferred form, small concentrations of palladium and/or platinum ions are added to ionic nickel and/or cobalt solutions. The ratio of nickel and/or cobalt ions to palladium and/or platinum ions is critical. A hot solution of the metal ions of nickel and/or cobalt and palladium and/or platinum is mixed with hydrazine in a hot basic aqueous solution, and rapidly diluted with hot water. The precipitate formed is filtered, sequentially chemically washed and dried. The dried alloy product is a black, non-pyrophoric, magnetic powder. Examination by electron probe and X-ray diffraction shows the alloy product to be a solid solution of the constituent metals. Scanning electron microscopy and BET surface area measurement establishes that the ultimate particles are submicron.

23 Claims, 3 Drawing Figures

NON-PYROPHORIC SUBMICRON ALLOY POWDERS OF GROUP VIII METALS

RELATED APPLICATIONS

None.

Disclosure Documents Recorded in the United States Patent Office as follows:

May 14, 1986—No. 150,278
May 15, 1986—No. 150,355
Apr. 24, 1986—No. 149,368
Apr. 24, 1986—No. 150,267

BACKGROUND OF THE INVENTION

1. Field of the Invention

The invention comprises processes for the formation of ultrafine metal powders by forming solid solutions with stable metals. More specifically, the present invention is directed to of non-pyrophoric submicron magnetic alloy powders from Group VIII metals. Such metals have varied utility in the fields of: catalysis, communications, electrical contacts, magnetics, electron emission and related circuitry, alloying and brazing, reduction, hydrogenation, chemical catalysis, ignition and the like. Submicron or ultrafine alloy powders are herein defined as having specific surface areas greater than one square meter per gram and equivalent spherical diameter of less than one micron.

2. Prior Art

In finally divided forms, many metal powders become highly reactive, especially, toward our oxygen-containing atmosphere. For example, ultrafine iron powder is pyrophoric and many Raney nickel catalysts ignite spontaneously when dried and exposed to the atmosphere. Aluminum metal pigments may explode if subjected to a spark or flame. Accordingly, it is very desirable to create ultrafine metal powders which may be handled without concern for the likelihood of spontaneous ignition or combustion. It is known that one way to increase the stability of a metal toward oxidation is through alloying; nontheless, the alloying does not permit the production of submicron alloy powders. Some metals such as platinum and gold can be produced in finely divided form without being pyrophoric, however their very high cost severely limits practical applications.

Examples of prior art relating to stabilization of metals and to fine metal represented in the powders are the following United States Letters Patent:

U.S. Pat. No. 4,485,153 dated Nov. 27, 1984—Conductive Pigment—Coated Surfaces—Inventor Daniel S. Janikowski.

U.S. Pat. No. 4,447,391 dated May 8, 1984—Brazing Alloy Containing the Active Metals, Precious metals, Boron and Nickel—Inventor Howard Mizuhara.

U.S. Pat. No. 4,081,710 dated Mar. 28, 1978—Platinum—Coated Igniters—Inventors Alane E. Haywood, et al.

U.S. Pat. No. 3,348,770 dated Apr. 15, 1969—Brazing Alloy of Improved Workability Containing Nickel and Palladium—Inventor Charles A. Clark, et al.

U.S. Pat. No. 3,882,050 dated May 6, 1975—Method of Depositing A Noble Metal on a Surface of a Nickel Support.

U.S. Pat. No. 3,032,515 dated May 1, 1962—Method of Preparation and Stabilization of Catalysts—Inventor Orville N. Hinsgar.

U.S. Pat. No. 2,977,327 dated Mar. 28, 1961—Process of Producing Nickel Catalysts—Inventor Murray Raney.

U.S. Pat. No. 2,269,497—Nickel—Platinum Alloy—Inventor Michael B. Vilensky.

U.S. Pat. No. 1,832,307—Alloy for Electrical Contracts—Inventor Edwin F. Kingsbury.

French Pat. No. 2,530,160 Nat'l No. 8311790—Catalyseur etc.

SUMMARY OF INVENTION

Since it is desirable to produce an ultrafine, catalytically active and air-stable alloy powder by a process that neither changes the structure, grain size, nor catalytic activity of the metal, the following is submitted in summary of the invention.

Ultrafine palladium metal can be precipitated from solutions by the addition of hydrazine. As formed, these fine palladium powders are stable and present unusually high surface areas which are typically associated with catalytic activity and utility. Nonetheless, palladium and other such noble metals as platinum are extraordinarily expensive, exceeding in value thousands of dollars per pound. Far less expensive among the Group VIII metals are, of course, cobalt and nickel, Raney nickel being among them as an effective catalyst, but it ignites spontaneously on drying in air and the powder thereof cannot be precipitated by the use of hydrazine or similar reducing agents. Under such conditions, nickel forms basic complexes and coordination compounds plus a variety of non-metallic precipitates. In view of the fact that nickel and palladium are isostructural, i.e., have similar lattice spacing and form extensive solid solutions in one another, the present invention has been created, where by adding small concentrations of palladium and/or platinum ions to ionic nickel and/or cobalt solutions, it becomes possible to precipitate a solid solution of the constituent metals. This metallic precipitate not only exhibits high surface area, but is stable in air even at temperatures approaching 100° C. Thus, the invention is directed to the formation of solid solutions of one Group VIII element in another to stabilize certain otherwise highly reactive structures.

The stabilizing element selected from the noble metals of Group VIII, per se need only be present in low concentrations as for example low concentrations of palladium in cobalt, in nickel, and/or platinum in nickel. Through this process is produced a black submicron magnetic alloy powder in which the noble metal is homogenously dispersed in the nickel and/or cobalt structure. The specific concentration ranges will be set forth hereinafter. However, typically the weight ratio of noble metal to base metal necessary to produce desirable spontaneous nucleation has been found to be less than 1 to 30.

DESCRIPTION OF PREFERRED EMBODIMENTS

Figure 1:
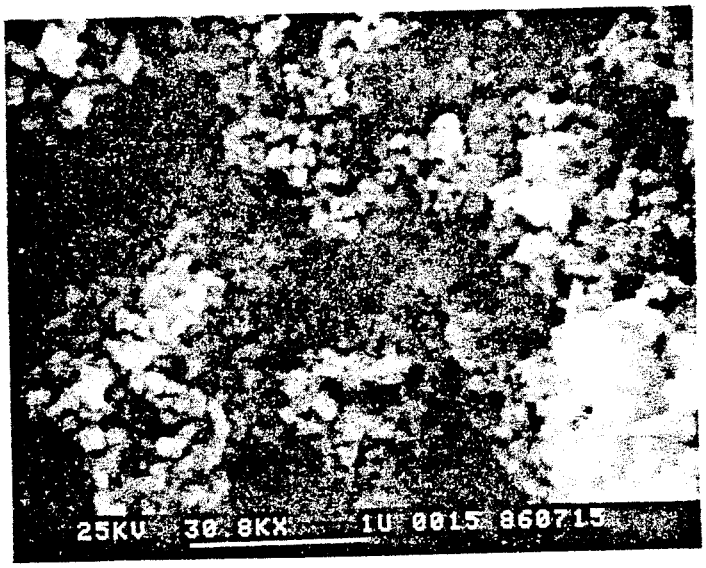
FIG. 1 is an illustrative photograph of a stabilized ultrafine alloy powder manufactured in accordance with the process of invention.
Figure 2:
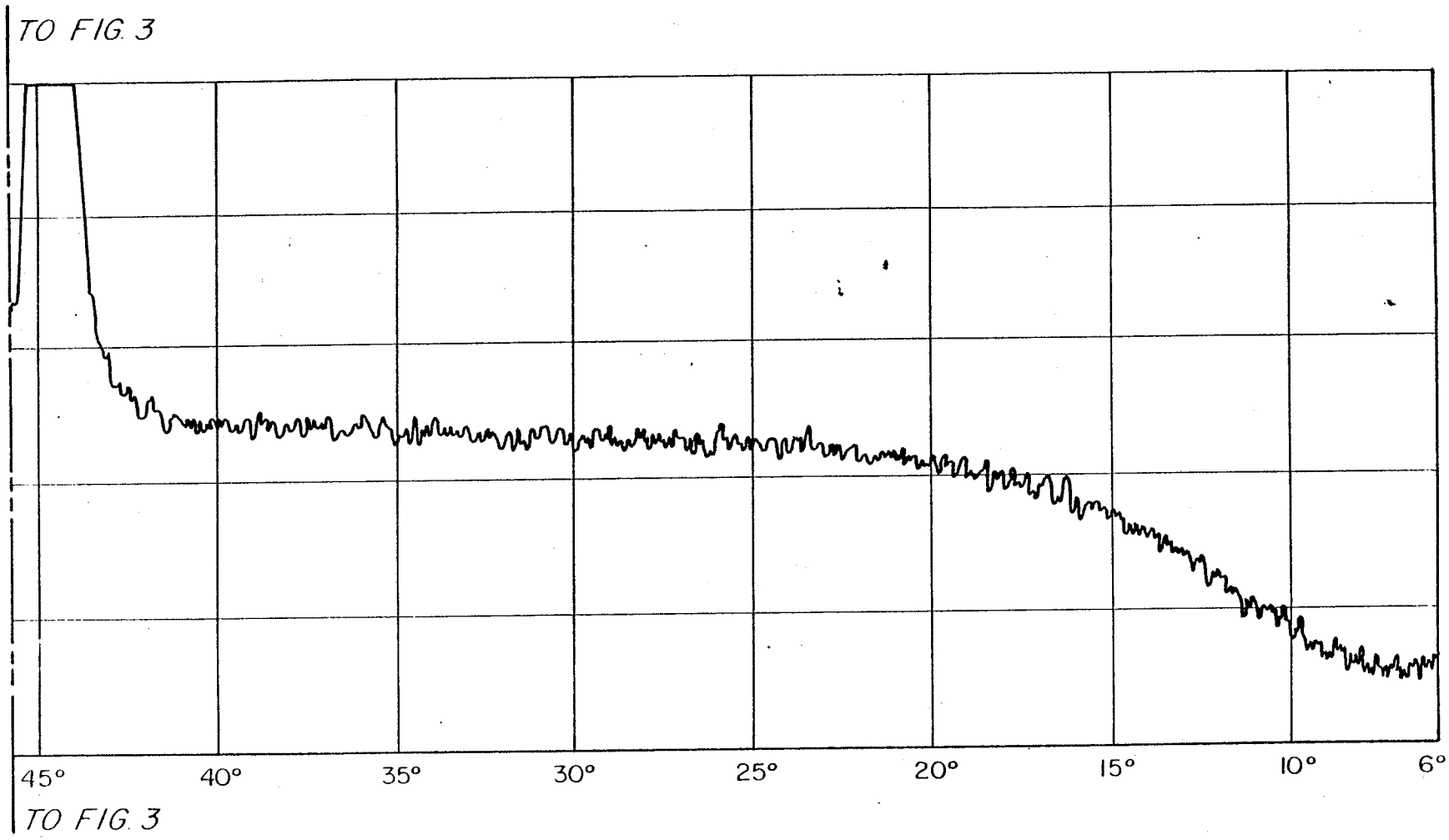
FIGS. 2 and 3 illustrate an X-ray diffraction pattern of such a stabilized submicron powder as in FIG. 1.
Figure 3:
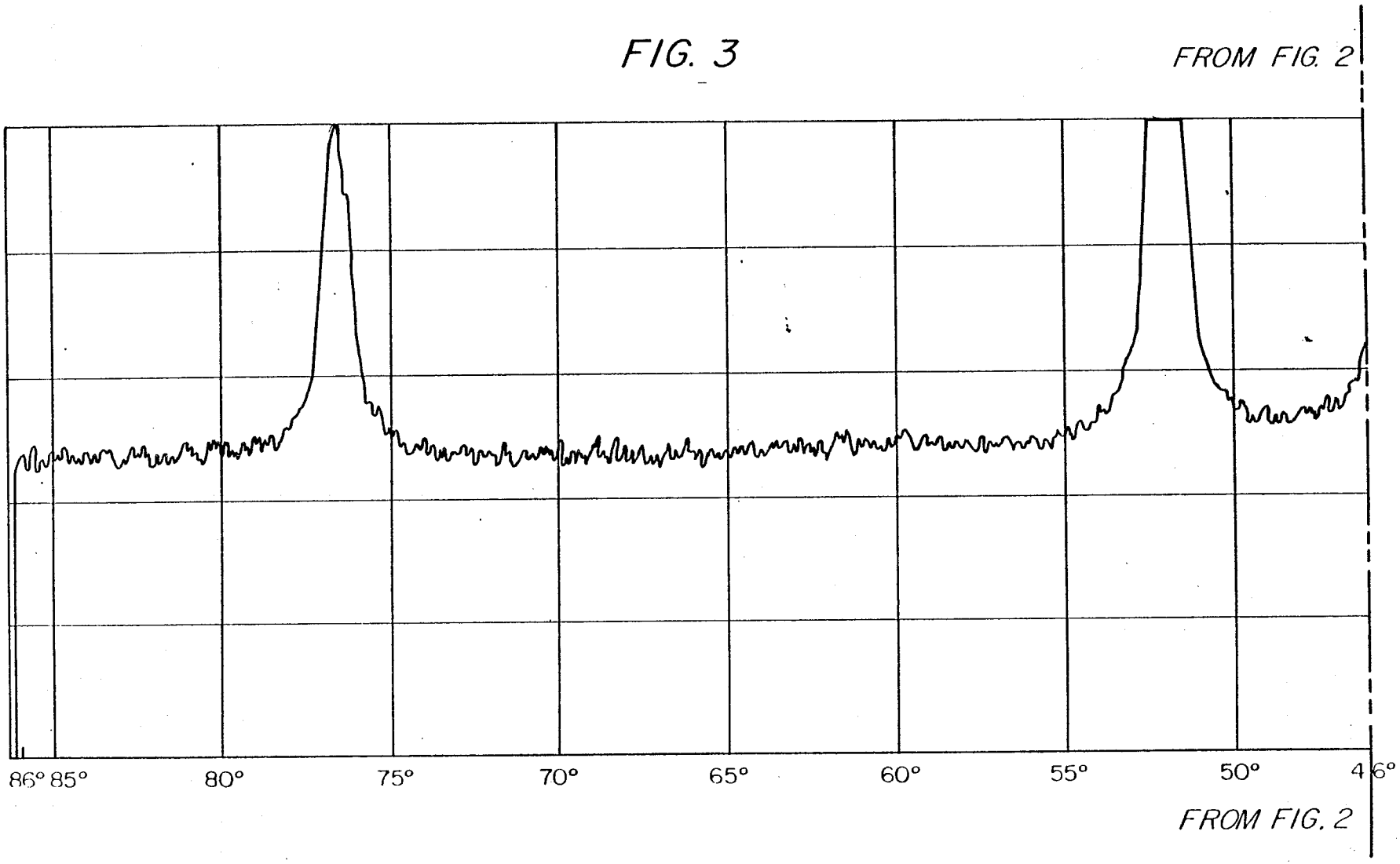

The product is submicron nickel and/or cobalt stabilized by the formation of a solid solution of noble Group VIII metal atoms in the lattice. It is, typically, a soft, black, magnetic, non-pyrophoric submicron powder alloy having surface areas in the range of 1-100 square meters per gram. Such surface areas correspond to equivalent spherical particle diameters of 0.67 to 0.0067 microns. In the FIG. 1 example, which was obtained by scanning electron microscopy, nickel-palladium alloy powder was precipitated in the presence of 0.5 weight percent of palladium. Electron photomicrography at 30,800 times magnification shows that the ultimate crystallite size in the alloy is significantly less than 0.1 microns. The X-ray diffraction pattern of FIGS. 2 and 3 shows that the only crystalline phase present corresponds to nickel metal. Moreover, the concentration of the noble Group VIII metal or metals in the ultrafine metal alloy powder is no less than 0.025 weight percent.

The process for producing such a product, involves mixing a hot aqueous solution of the base metal and noble metal ions with a hot alkaline solution of a reducing agent such as hydrazine. This mixture is immediately diluted into boiling water. The precipitate is filtered, sequentially washed and dried to produce the desired product.

The invention is best understood by reference to the following examples which will further illustrate the nature and scope thereof.

EXAMPLE 1

Three solutions were prepared under ambient atmospheric conditions:

Solution (a) contained 75 grams of divalent nickel ions, provided by dissolving 304 grams of nickel (II) chloride hexahydrate ($NiCl_2.6H_2O$), and 0.75 grams of palladium, provided by dissolving 1.25 grams of palladium (II) chloride ($PdCl_2$) in deionized water and diluting the solution to 600 milliliters total. Solution (b) contained 40 grams of sodium hydroxide (NaOH), 90 milliliters of concentrated ammonium hydroxide ($NH_4OH$) and 95 grams of hydrazine hydrate ($N_2H_4.H_2O$), all dissolved in deionized water, and diluted to a total volume of 600 milliliters. Solution (c) consisted of 500 milliliters of deionized water only, to which a small quantity (unmeasured) of antifoaming agent was added.

Solutions (a) and (b) were heated to 85°-100° C., and solution c to boiling. Solutions (a) and (b) were mixed by pouring them into a mixing funnel at a rate of 100 milliliters per minute, and the mixture was directed continuously into the boiling water solution (c). After a short induction period of less than 1 minute a black precipitate formed.

The precipitate was recovered by filtration, washed repeatedly with hot, 10 weight percent ammonium hydroxide solution, then with acetone, and dried at about 60° C.

Product recovery was of the order of 96 percent of the calculated amount namely: 72 grams/75 grams. It was black, and magnetic, and was shown by x-ray diffraction to contain no detectable crystalline phases other than nickel metal. No detectable crystallites were exhibited at a magnification of 20,000 times in a scanning electron microscope. Analyses showed the product alloy to contain 93.8 percent nickel and 1.25 percent moisture. Other than a homogenously distributed trace of palladium observed by electron probe, no other elements were analyzed for nor observed. Surface area, measured by the BET sorption method was 50 square meters per gram, corresponding to an equivalent mean spherical diameter of 0.01 micron. This experiment corresponded to a palladium concentration of 1 percent of the weight of nickel.

EXAMPLE 2

Another experiment was run in which the palladium concentration was 0.125 percent the weight of nickel.

Three solutions were prepared under ambient atmospheric condition:

Solution (a) contained 15 grams of divalent nickel ions, provided by dissolving 60.8 grams of nickel (II) chloride hexahydrate ($NiCl_2.6H_2O$), and 0.019 grams of palladium, provided by dissolving 0.32 grams of palladium (II) chloride ($PdCl_2$) in deionized water and diluting the solution to 150 milliliters total. Solution (b) contained 9 grams of sodium hydroxide (NaOH), 20 milliliters of concentrated ammonium hydroxide ($NH_4OH$) and 18 milliliters of hydrazine hydrate ($N_2H_4.H_2O$), all dissolved, and diluted to 150 milliliters total. Solution (c) consisted of 200 milliliters of deionized water only, to which a small quantity (unmeasured) of antifoaming agent was added. All solutions were preheated to 85°-100° C.

Procedure and results were substantially similar to Experiment No. 1. Yield was of the order of 95 percent, the product alloy was black and magnetic. X-ray diffraction showed the presence of no crystalline phases other than nickel.

EXAMPLE 3

This experiment was identical to Example 2 except that the palladium concentration was reduced to 0.025 percent of the nickel concentration.

The precipitate that formed, unlike that in Examples 1 & 2, was gelatinous, very dark blue grey in color, and was only very weakly magnetic. X-ray diffraction showed a number of peaks corresponding to crystalline phases other than nickel metal. Yield was significantly less than in examples 1 & 2.

EXAMPLE 4

To show the generality of the concept, platinum was substituted for palladium in the formation of alloy powders.

Solution (a) contained 10 grams Nickel (II) ions, 0.35 grams platinum IV ions in 150 milliliters of deionized water. Solution (b) contained 11 grams sodium hydroxide (NaOH) and 8 grams hydrazine hydrate ($N_2H_4H_2O$) in 150 milliliters of solution. Solution (c) consisted of 200 milliliters of deionized water containing a trace of antifoaming agent.

The black precipitate was magnetic and showed only homogeneous dispersed traces of platinum in nickel, by electron probe. No crystalline phase other than nickel was detected by X-ray diffraction.

Substantially similar experiments were conducted with a composite of cobalt and nickel base metals with the following charted results:

| Pd Concentration (Wgt. %) | Co/Ni Weight Ratio 100/0 | 90/10 | 80/20 | 50/50 | 0/100 |
|---|---|---|---|---|---|
| 3.0 | STABLE* | | | | |
| 1.0 | UNSTABLE** | | | | |
| 0.1 | | UNSTABLE | STABLE | STABLE | |
| 0.05 | | | UNSTABLE | | STABLE |
| 0.025 | | | | | UNSTABLE |

*STABLE herein denotes the formation of the desired black, metallic precipitates which did not oxidize on drying.

**UNSTABLE denotes the failure to form the black, metallic precipitates and the formation of insoluble basic complexes or the oxidation of the black precipitate on drying.

Whereas the invention has been defined with specific reference to product wherein the base metals of Group VIII include of nickel and/or cobalt, the Group VIII noble metals include of platinum and/or palladium, it is within the spirit of invention that the metal iron be included within the base metals class and the metals rhodium ruthenium, osmium and iridium be included within the noble metal class, all in combinations indicated within the product claims which follow. The invention likewise comprehends the admixture of iron with the base metal or metals selected; and also the admixture of the above listed noble metals with the exemplary metals palladium and/or platinum. In actual practice the concentration of the at least one noble Group VIII metal in the ultrafine metal alloy powder is no less than 0.025 weight percent.

Having now defined the invention as to product, the ensuing claims are affirmative of its scope.

We claim:

1. An ultrafine non-pyrophoric magnetic metal alloy powder the particle size of which is less than one micron, consisting of at least one Group VIII base metal and at least one Group VIII noble metal, the at least one noble metal being in a concentration sufficient to have induced spontaneous nucleation, the x-ray diffraction pattern of the metal alloy powder exhibiting essentially the pattern of the at least one base metal phase, but wherein the at least one noble metal is homogeneously dispersed in the at least one base metal structure.

2. An ultrafine non-pyrophoric magnetic metal alloy powder the particle size of which is less than one micron, consisting of at least one Group VIII base metal and at least one Group VIII noble metal, the at least one noble metal being in a concentration sufficient to have induced spontaneous nucleation from an aqueous ionic solution of the respective base and noble metals, the x-ray diffraction pattern of the metal alloy powder exhibiting essentially the pattern of the at least one base metal phase, but wherein the at least one noble metal is homogeneously dispersed in the at least one base metal structure.

3. The non-pyrophoric ultrafine metal alloy powder of either claim 1 or 2 wherein the concentration of the at least noble Group VIII metal in the powder is no less than 0.025 weight percent.

4. The non-pyrophoric ultrafine metal alloy powder of either claim 1 or 2 wherein the at least one Group VIII noble metal is palladium.

5. The non-pyrophoric ultrafine metal alloy powder of either claim 1 or 2 wherein the at least one Group VIII noble metal is platinum.

6. The non-pyrophoric ultrafine metal alloy powder either of claim 1 or 2 wherein the at least one Group VIII base metal is nickel.

7. The non-pyrophoric ultrafine metal alloy powder of either claim 1 or 2 wherein the at least one Group VIII base metal is cobalt.

8. The non-pyrophoric ultrafine metal alloy powder of either claim 1 or 2 comprising two base metals one being nickel and the other being cobalt as a solid solution.

9. The non-pyrophoric ultrafine metal alloy powder of either claim 1 or 2 comprising two noble metals one being palladium and the other being platinum, both said noble metals being homogeneously dispersed in base metals structure.

10. The non-pyrophoric ultrafine metal alloy powder of claim 8 wherein the two noble metals are palladium and platinum, both said noble metals being homogeneously dispersed in base metals structure.

11. The non-pyrophoric ultrafine metal alloy powder of claim 3 wherein the at least one Group VIII noble metal is palladium and the at least one Group VIII base metal is nickel.

12. The non-pyrophoric ultrafine metal alloy powder of claim 3 wherein the at least one Group VIII noble metal is platinum and the at least one Group VIII base metal is nickel.

13. The non-pyrophoric ultrafine metal alloy powder of claim 3 wherein the at least one Group VIII noble metal is palladium and the at least one Group VIII base metal is cobalt.

14. The non-pyrophoric ultrafine metal alloy powder of claim 3 wherein the at least one Group VIII noble metal is platinum and the at least one Group VIII base metal is cobalt.

15. The non-pyrophoric ultrafine metal alloy powder of claim 3 wherein the at least one Group VIII noble metal is palladium and the base metals are nickel and cobalt.

16. The non-pyrophoric ultrafine metal alloy powder of claim 3 wherein the at least one Group VIII noble metal is platinum and the Group VIII base metals are nickel and cobalt.

17. The non-pyrophoric ultrafine metal alloy powder of claim 3 wherein the base metals of Group VIII are nickel and cobalt and wherein the noble metals of Group VIII are palladium and platinum, the latter being homogeneously dispersed in basic metals structure.

18. The non-pyrophoric ultrafine metal alloy powder according to either claim 1 or 2 wherein the Group VIII basic metals are selected from the class: nickel, cobalt and iron and mixtures thereof.

19. The non-pyrophoric metal alloy powder according to either claim 1 or 2 wherein the Group VIII noble metals are selected from the class: palladium, platinum, rhodium, ruthenium, iridium and osmium and mixtures thereof.

20. The non-pyrophoric metal alloy powder according to claim 3 wherein Group VIII base metals are selected from the class: nickel, cobalt and iron and mixtures thereof.

21. The non-pyrophoric ultrafine metal alloy powder according to claim 3 wherein the Group VIII noble metals are selected from the class: palladium, platinum, rhodium, ruthenium, iridium and osmium and mixtures thereof.

22. The non-pyrophoric ultrafine metal alloy powder according to either claim 1 or 2 wherein the Group VIII base metals are selected from the class: nickel, cobalt or iron and mixtures thereof, and wherein the Group VIII noble metals are selected from the class: palladium, platinum, rhodium, ruthenium, iridium or osmium and mixtures thereof, the latter being disposed in base metals structure.

23. The non-pyrophoric ultrafine metal alloy powder according to claim 3 wherein the Group VIII base metals consist of: nickel, cobalt or iron and mixtures thereof and wherein the Group VIII noble metals consist of: palladium, platinum, rhodium, ruthenium, iridium or osmium and mixtures thereof, the latter being disposed in base metals structure.

* * * * *